United States Patent [19]

Heller et al.

[11] 4,174,045

[45] Nov. 13, 1979

[54] LOADING PLATFORM

[75] Inventors: Karl H. Heller, Gehrden; Dieter Schiron, Hanover, both of Fed. Rep. of Germany

[73] Assignee: Continental Gummi-Werke Aktiengesellschaft Hanover, Fed., Rep. of Germany

[21] Appl. No.: 855,929

[22] Filed: Nov. 29, 1977

[30] Foreign Application Priority Data

Dec. 1, 1976 [DE] Fed. Rep. of Germany ..... 26543806

[51] Int. Cl.[2] ..... B65D 7/00; B65D 87/00; B65D 9/12

[52] U.S. Cl. ..... 220/4 F; 206/512; 220/1.5; 217/43 A

[58] Field of Search ..... 206/512, 511; 220/1.5, 220/4 R, 4 F, 19, 75, 76; 217/12 R, 43 R, 43 A, 65

[56] References Cited

U.S. PATENT DOCUMENTS

| | | | |
|---|---|---|---|
| 2,775,360 | 12/1956 | Phillips | 206/512 X |
| 3,401,814 | 9/1968 | Chiswell et al. | 220/1.5 X |
| 3,402,845 | 9/1968 | Eriksson | 220/1.5 |
| 3,478,914 | 11/1969 | Williams | 220/4 F |
| 3,883,026 | 5/1975 | Selz | 220/1.5 X |

*Primary Examiner*—Steven M. Pollard
*Attorney, Agent, or Firm*—Becker & Becker, Inc.

[57] ABSTRACT

A preferably metallic platform which is adapted to be stacked and is provided with supports for receiving and supporting another loading platform. The platform also includes side walls which are adapted detachably to engage the insides of the supports. The side walls in the corner regions of their upper edges are positively connected to the supports which in the vertical direction are detachable from the loading platform.

5 Claims, 2 Drawing Figures

LOADING PLATFORM

The present invention relates to a loading platform, preferably of metal, with supports for receiving one or more further loading platforms to be placed thereon, and with side walls disengagingly mountable on said supports.

For storing and/or transporting piecegoods of various types, stackable loading plates, so-called stackable platforms or pallets are used to a great extent in industrial establishments, storage places and in the general freight traffic. The mostly rectangular or square shaped basic form suggests to arrange the supports at the four corners. The detachable mounting of the supports offers the advantage of considerably reducing the empty volume of the loading platforms for return freight. The employment possibilities of such loading platforms can be considerably broadened by providing disengageable or foldable side walls. The connection of the side walls to the supports or to each other gives rise to special problems resulting from partly contrasting requirements concerning simple handling, reliable holding under rough conditions of use, resistance against mechanical stresses, requiring little repair work, and easy transformation from the position of use to transport position when empty.

The heretofore known designs with lever and locking systems and other connecting elements proved not to meet the requirements in practice, at least not for any longer period of time so that regardless of the various heretofore known designs, the requirement for fundamental improvements still existed.

It is, therefore, an object of the present invention to provide a loading platform which will overcome the above mentioned drawbacks and will represent a suitable rugged connection of the side walls which can be established quickly and simply with a minimum of parts, can also be easily disassembled and will under all conditions result in a satisfactory connection of the side walls.

These and other objects and advantages of the invention will appear more clearly from the following specification in connection with the accompanying drawings, in which.

The loading platform according to the invention which preferably is of metal and which can be stacked while being provided with supports for receiving and supporting additional loading platforms is characterized primarily in that the side walls are inserted and engage the inner walls of the supports and in the corner regions of their upper edges are positively connected to the supports which are removable from the loading platform in vertical direction. According to a preferred embodiment of the invention, the free ends of the supports which consist of hollow profile beams, expediently of angle steel rolled profiles and adapted with the profile opening facing the loading space to be placed onto the loading platform, are provided with a cover with recesses or cutouts for receiving extensions on the upper edge of the side walls.

According to a further feature of the invention, the supports are at their lower region which is adjacent to the loading platform, provided with abutment means for instance in the form of recesses or cutouts for absorbing lifting forces acting upon the supports so that the desired possibility of detaching the positive connection with the side walls will be afforded by a simple lifting of the supports.

Figure 1:
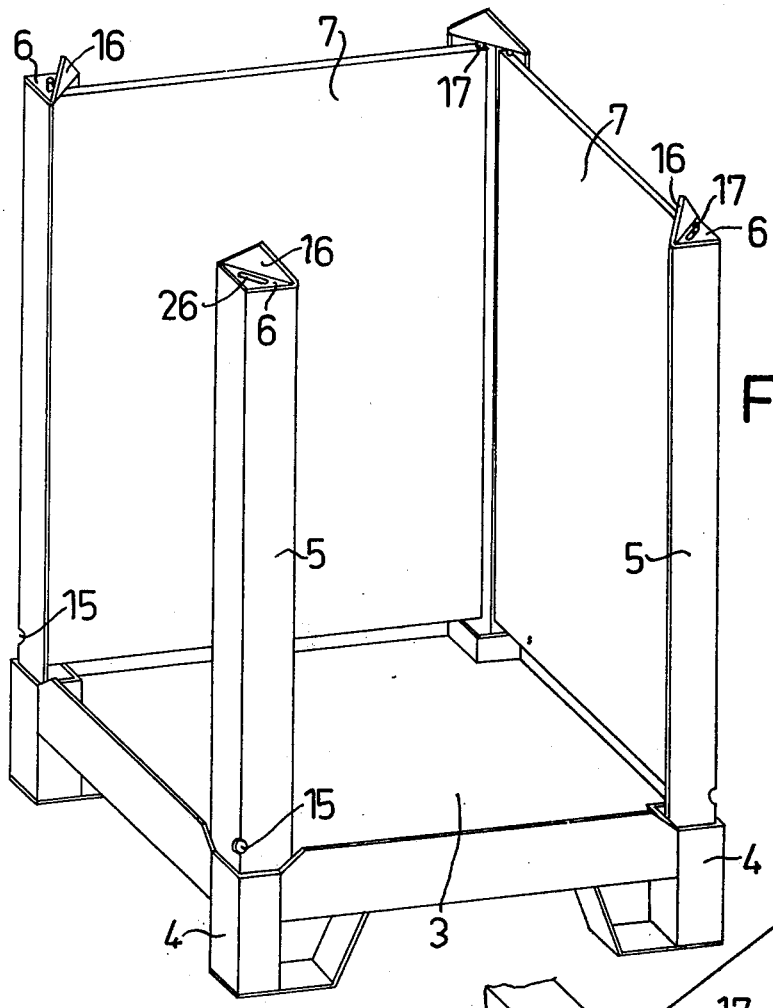
FIG. 1 represents an isometric view of a container loading platform forming a container pallet.
Figure 2:
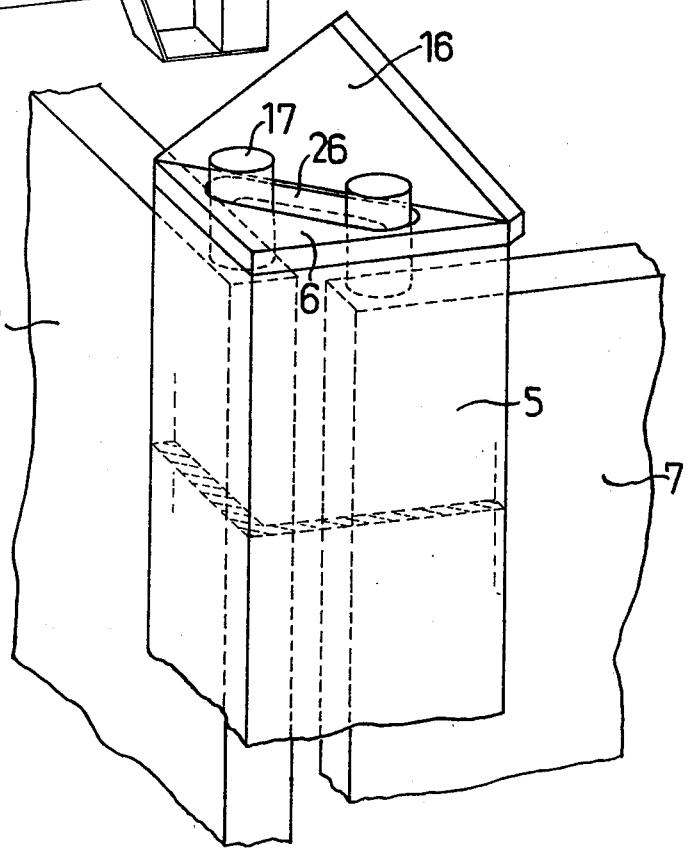
FIG. 2 represents an upper corner portion of the design shown in FIG. 1.

Referring now to the drawings in detail, the loading platform comprises a rectangular bottom plate 3 with feet 4 arranged at the four corners of said bottom plate 3. The feet 4 serve for resting the loading platform at a distance from the ground which is sufficient to permit the forks of a lift truck to reach below the bottom plate 3. The feet 4 also serve for loosely inserting the supports 5. The supports 5 consist of angle profiled-rolled steel and at their free upper ends are provided with a welded-on cover 6 for supporting a nonillustrated further loading platform. To this end, the cover plate 6 has a metal tip 16 which fits into the feet 4 of the loading platform. Furthermore, the cover plate 6 is provided with a slot-shaped longitudinal recess 26 (FIG. 2).

The side walls 7 which in the illustrated embodiment consist of steel plates forming a solid wall and at their upper edge are provided with knub or pivot shaped mountings 17 forming an extension of the outer rim edges of the side walls 7. These mountings 17 engage recesses 26 in the cover 6 of the supports 5 and form a reliable positive connection between these two parts. For purposes of building up the loading platform as a container pallet, the side walls 7 are successively in inclined position leaned against the inner side of the supports 5, and after the mountings 17 have from below been inserted into recesses 26 are pivoted into the illustrated position of use. In the latter, inserted loading goods will press the side walls firmly against the profiled legs of the supports 5 and thus will assure maintaining this position.

For purposes of emptying the container pallets, two supports 5 arranged adjacent to each other are lifted upwardly out of the feet 4 so that the then free respective side walls 7 can be removed if they have not already fallen outwardly due to the pressure of the loaded goods. Bores 15 in the lower end section of said supports 5, which means in the end section facing the bottom plate 3 furnish the possibility of employing lifting means from the outside of the platform upon the latter. Levers or hooks may engage said bores 15. As will be evident from the above, the present invention discloses a loading platform which at will may be employed with or without side walls and which can with a minimum of parts and at low cost be converted into another useful shape. In view of the side walls engaging the inner side of the supports 5, the side walls afford an optimum exploitation of the available loading surface with a practically loss-free enclosed maximum inner shape. The positive connection of the side walls with the supports within the region of the free upper ends of the latter assures on one hand an extremely firm, reliable and under all circumstances safe mounting and on the other hand permits a surprisingly simple handling in condition of use. For inserting the side walls it is merely necessary to move their upper extensions into the provided recesses or cutouts in the covers of the supports. No further arresting is necessary because the side walls will already due to the static pressure of the loaded goods have the tendency to rest against the supports.

In order to remove one or more side walls for unloading the pallets, it will suffice when two adjacent supports by means of a lifting force are lifted in vertical direction out of their mounts in the loading platform so that the engaged side wall will be free and can be removed in conformity with the pressure of the loaded material acting thereupon. Inasmuch as the displacement of the support necessary for this purpose relative to the stationary side walls is countered by a comparatively considerably lower friction with regard to the large surface engagement of the side walls against the loaded goods, the displacement of the supports is independent of the type and property of the loaded material and the filling condition of the loading platform and can be effected with relatively low force. The connection requires no additional movable part as for instance levers, latches, or turnbuckles or the like. The design according to the present invention is therefore not likely liable to repairs, and even after considerable local deformation and other damage to the side walls and/or supports is still fully functional.

The design of the side walls in detail is of secondary importance. The invention can be used equally well with full walls for transporting substances which are difficult to handle and may be plastic or viscous or may be of pulverous and granular type. The side walls may also be in the form of lattice-work for transporting small volume piecegoods of various types.

It is, of course, to be understood that the present invention is, by no means, limited to the specific showing in the drawings, but also comprises any modifications within the scope of the appended claims.

What we claim is:

1. A stackable loading platform, especially metallic platform, having a bottom with a plurality of corners, which includes in combination: a plurality of supports made of profiled rolled steel beams respectively located at said corners and detachably arranged therein, and a plurality of side walls arranged between and detachably engaging the respective adjacent supports, said side walls in the corner regions of their upper edges being positively connected to said supports upon insertion of said side walls from below, said supports being selectively movable in the longitudinal direction thereof away from said bottom for removing said supports from said platform, said side walls being releaseable from said supports which are shiftable at right angles thereto.

2. A stackable loading platform in combination according to claim 1, in which said supports are profiled beams of an angular cross section, and which includes cover means respectively arranged at the free ends of said supports, the upper edge of said side walls in the region of said supports being provided with upwardly extending extensions, and said cover means being provided with cutouts for receiving said extensions.

3. A stackable loading platform in combination according to claim 2, in which the corner portions of said bottom comprises sleeve means for receiving the lower ends of said supports so that the cross sectional angle of said supports faces the loading space of said platform.

4. A stackable loading platform in combination according to claim 1, which within the region of said bottom is provided with abutment means for receiving lifting forces exerted upon said abutment means.

5. A stackable loading platform in combination to claim 4, in which said abutment means include cutouts provided in said supports.

* * * * *